US010837218B2

(12) United States Patent
Robson

(10) Patent No.: US 10,837,218 B2
(45) Date of Patent: Nov. 17, 2020

(54) BANK NOTE PROTECTION

(71) Applicant: MAGNETO IP HOLDINGS (PTY) LTD, Johannesburg (ZA)

(72) Inventor: Michael Donald Robson, Johannesburg (ZA)

(73) Assignee: MAGNETO IP HOLDINGS (PTY) LTD, Johannesburg (ZA)

( * ) Notice: Subject to any disclaimer, the term of this patent is extended or adjusted under 35 U.S.C. 154(b) by 0 days.

(21) Appl. No.: 14/419,015

(22) PCT Filed: Aug. 1, 2013

(86) PCT No.: PCT/ZA2013/000061
§ 371 (c)(1),
(2) Date: Feb. 2, 2015

(87) PCT Pub. No.: WO2014/022868
PCT Pub. Date: Feb. 6, 2014

(65) Prior Publication Data

US 2015/0191960 A1 Jul. 9, 2015

(30) Foreign Application Priority Data

Aug. 2, 2012 (ZA) ..... 2012/05813
Nov. 16, 2012 (ZA) ..... 2012/08693
(Continued)

(51) Int. Cl.
*E05G 1/14* (2006.01)
*G07D 11/12* (2019.01)
(Continued)

(52) U.S. Cl.
CPC ..... *E05G 1/14* (2013.01); *B65D 85/00* (2013.01); *E05G 1/02* (2013.01); *E05G 5/00* (2013.01); *G07D 11/12* (2019.01); *G07D 11/125* (2019.01)

(58) Field of Classification Search
CPC .. E05G 7/001; E05G 1/00; E05G 1/14; E05G 2700/00; E05G 2700/02; E05G 2700/04;
(Continued)

(56) References Cited

U.S. PATENT DOCUMENTS 1,936,385 A * 11/1933 Dilatush ..... E05G 1/024 109/25
2,035,498 A * 3/1936 Navis ..... E05G 1/14 101/3.1
(Continued)

FOREIGN PATENT DOCUMENTS

| | | |
|---|---|---|
| EP | 1 640 546 A1 | 3/2006 |
| GB | 2 484 484 A | 4/2012 |
| WO | 2012/061852 A1 | 5/2012 |

OTHER PUBLICATIONS

International Search Report, dated Dec. 9, 2013, from corresponding PCT application.

*Primary Examiner* — Jeffrey A Shapiro
(74) *Attorney, Agent, or Firm* — Nixon & Vanderhye

(57) ABSTRACT

A protective device which includes a sealed container which is made from a material which breaks under the effect of a shock wave in excess of a predetermined magnitude and a substance inside the container that gives rise to a bank note traceability factor.

17 Claims, 6 Drawing Sheets

(30) Foreign Application Priority Data

Feb. 18, 2013 (ZA) ..... 2013/01216
Apr. 22, 2013 (ZA) ..... 2013/02885
May 29, 2013 (ZA) ..... 2013/03894

(51) Int. Cl.
*G07D 11/125* (2019.01)
*B65D 85/00* (2006.01)
*E05G 1/02* (2006.01)
*E05G 5/00* (2006.01)

(58) Field of Classification Search
CPC ..... E05B 65/0082; G08B 15/02; G08B 13/00; G08B 15/00; G08B 21/0297; Y10T 70/20
USPC ..... 109/20, 25, 29–34, 24, 24.1, 45, 47; 206/532; 235/15, 16, 1 D
See application file for complete search history.

(56) References Cited

U.S. PATENT DOCUMENTS 4,363,279 A * 12/1982 Johansson ..... G07D 11/0009 109/20
4,670,950 A * 6/1987 Wisecup ..... E05B 73/0017 116/200
5,156,272 A * 10/1992 Bouchard ..... E05G 1/14 109/25
5,208,085 A * 5/1993 Pace ..... A47G 29/1209 109/25
5,309,740 A * 5/1994 Hansen ..... E05B 73/0017 24/704.1
5,598,793 A * 2/1997 Lopez, Jr. ..... E05G 1/14 109/25
5,617,799 A * 4/1997 Kaczorowski ..... G08B 15/02 109/20
5,918,554 A * 7/1999 Rassamni ..... E05G 1/12 109/29
6,033,387 A * 3/2000 Brunel ..... A61M 5/24 604/110
6,712,011 B2 * 3/2004 Fumanelli ..... G08B 15/02 109/20
6,895,873 B1 * 5/2005 Searle ..... E05G 1/005 109/25
8,631,748 B2 * 1/2014 Tavares de Pinho ..... E05G 1/14 109/20
2002/0029728 A1 * 3/2002 Walker ..... E05G 1/14 109/25
2003/0033965 A1 * 2/2003 Van Lint ..... E05G 1/14 109/29
2004/0007165 A1 * 1/2004 Abe ..... G08B 15/02 109/20
2005/0000396 A1 * 1/2005 Dyson ..... E05G 1/14 109/25
2005/0010525 A1 * 1/2005 Ross ..... G06K 7/0008 705/43
2005/0051448 A1 * 3/2005 Miles ..... G07D 11/0009 206/459.1
2005/0121508 A1 * 6/2005 Fumanelli ..... A45C 13/24 235/379
2009/0235847 A1 * 9/2009 Villiger ..... E05G 1/14 109/25
2010/0193582 A1 * 8/2010 Johnson ..... G07D 11/0009 232/1 D

* cited by examiner

BANK NOTE PROTECTION

BACKGROUND OF THE INVENTION

This invention relates to the protection of bank notes.

Automatic teller machines (ATM's) are used to dispense bank notes to the public. Containers filled with bank notes are loaded into the machines which can be accessed by means of authenticated cards, strokes or inputs on a keyboard or the like, to allow money to be drawn from designated accounts. Unfortunately, although ATM's are fortified and protected, they are vulnerable to explosive attack. A variety of substances are used in an explosive attack. Chemical compositions such as dynamite or more modern explosives e.g. of the kind used in rock breaking or mining are employed with great effect. Access to these types of explosives is however often tightly controlled and, as an alternative, gaseous compositions are increasingly being used. For example acetylene from a gas bottle is introduced to an ATM. The gas mixes with oxygen in the atmosphere and, at a critical gas concentration, the mixture can be ignited to release a substantial explosive force. These explosives are used, literally, to blast an ATM apart and, when this occurs, bank notes in the containers can be accessed or the bank notes are released when the containers are destroyed by an explosive force.

It is not feasible to prevent an explosive attack for the initiative to use an explosive lies with the perpetrator. An attempt has been made to negate the success of this type of attack though by including, between the bank notes, at regular intervals, sachets formed from a soft plastic material. Each sachet is sealed and contains a bank note ink. An objective in this respect is that at least one sachet will be broken by an explosive shock wave and the ink will be released at least onto notes which are adjacent the sachet. The lifetime of this type of sachet is, however, limited for the sealing process, to enclose the ink in a sachet, is not warranted for an extended period. Also, each sachet must be handled while the bank notes are being packed, a step which intrudes on a conventional bank note packing procedure.

Another method to counter an attack includes the use of a fully automated electronic system which monitors the ATM and an associated bank note holder. Ink is released upon sensing an unwarranted intrusion of the ATM or bank note holder. Although this system is effective in countering physical attacks or break-ins of the ATM machine, the efficacy is reduced in an explosive attack and often the system is destroyed before dye can be released onto the bank notes or warning signals can sent. This system is also expensive to install and maintain.

An object of the present invention is to provide an alternative method of protecting bank notes which, in a preferred embodiment, is passive (does not require an electrical input) and robust and able to withstand the effects of everyday wear and tear.

SUMMARY OF INVENTION

The invention provides, in the first instance, a protective device which includes a sealed container which is made from a material which breaks under the effect of a shock wave in excess of a predetermined magnitude and a substance inside the container that gives rise to a bank note traceability factor.

Under explosive attack the sealing of the container is broken or destroyed, after the container material cracks, or one part of the container becomes detached from the remainder of the container—these events are included in the meaning of "break" as used herein.

The container may include at least one aperture through which the substance is placed into the container. A suitable closure may be provided to seal the aperture.

The container can be made in any suitable way, e.g. blow moulding. A preferred material for use in the making of the container is high density polyethylene (HDPE). This however is illustrative and non-limiting. The nature of the material and its thickness are important parameters in ensuring that the container will break under a shock wave effect but will not break during normal usage.

In another form of the invention the container is made from a brittle material e.g. glass or a rigid plastic material which directly breaks or shatters under the effect of the shockwave.

The container may be made from a flexible material, and may be in the form of a bladder which breaks or ruptures when the container is exposed to a shockwave which exceeds a predetermined magnitude The substance may be of any suitable form which interacts with, or acts upon, the bank notes so that the bank notes are no longer standard. For example the notes may be dyed, have an adhesive attached to them, be impregnated with a smell, be attacked by a solvent, acid or other chemical, etc. so that each note marked or affected in this way is traceable i.e. it is distinguishable from a standard note. These substances may be used alone or in any appropriate combination so that, upon contacting a bank note, interaction with the note takes place on a semi-permanent but, preferably, in a permanent manner.

As certain bank notes are plasticised and therefore do not readily interact with substances such as a dye, a fluid adhesive may be used preferably in conjunction with a dye in order to ensure that the adhesive/dye combination gives rise to a traceability factor on the plasticised bank notes. The fluid adhesive may be of any suitable kind e.g. epoxy glue. This is not limiting. An alternative approach is to use a solvent, acid or other chemical which attacks the plasticising in an irreversible, and hence visible, manner.

The substance may release a noxious smell or gas, upon fracturing of the container, which impregnates the bank notes with a distinct odour. The noxious substance may be used on its own or in conjunction with the dye, an adhesive, a solvent or any other suitable chemical or combination of the aforegoing.

If an adhesive is used the adhesive may set e.g. harden and cling to each bank note it contacts. Also, the adhesive may join a number of bank notes together. The adhesive may however remain in a fluent or tacky form which, for practical purposes, cannot readily be removed.

If a bank note is plasticised then other materials which interact with the plastic e.g. solvents or the like can be used to ensure that the integrity of a bank note is attacked. For example reliance is placed on the effect of a chemical reaction through the action of a solvent, acid or other substance which interacts with the plastic used in the bank note.

The container may include more than one aperture and respective sealing means (e.g. a cap) engaged with each aperture. The volume of the container may be increased by shaping the container so that it occupies all available space inside an enclosure within which it is used.

The filling of the container with the substance should be carried out in an effective manner which facilitates subsequent sealing of the container. In one form of the invention, the container is formed with at least one elongate spout which allows the substance to be placed into the container interior and which allows air to escape from the container as it is being filled. This process may be facilitated by using two spouts, one for filling the container and one for allowing air to escape. In either case each spout is preferably made from a material, which may be the same as the material from which the container is made, which can be sealed after the filling process has been completed.

It is important for the substance to be sealed, in a leak-proof manner, in the container. A compromise must be struck between the container having a property that will allow the container to break or rupture to release its contents, when subjected to a shockwave of a predetermined magnitude, and to ensure that, in other situations, it will not leak.

The sealing may be effected in any appropriate way. For example a spout may be sealed by means of heat, ultrasonically or an equivalent process at a number of locations with each seal creating a leak-proof barrier. The spout may be sealed with an insert in the form of a plug, or by using an adhesive or similar process. Preferably a cap is threadedly engaged with the spout in order to seal the container.

Irrespective of the way in which the aperture is sealed it is desirable to use a cover to protect the integrity of the seal and to reduce the likelihood of tampering and accidental leaking. A preferred way of doing this is to use a heat-shrinkable material which is placed over the aperture, e.g. the spout, and which covers at least part of the spout and preferably also the cap or the plug once the heat-shrinkable material is activated.

A heat-shrinkable material which is not thick can be used to enclose the entire container to facilitate handling of the container and to reduce the likelihood of tampering and accidental leaking. The shrinkable material is however not robust and does not in any meaningful way affect the breaking of the container when exposed to a shockwave, nor the subsequent release of the substance inside the container.

To promote breaking or rupturing of the container material in a reliable and consistent manner one or more of the following techniques may be adopted.

The container may be formed with one or more zones which preferentially break or detach under the effect of a shockwave. For example the container may be formed with a body which includes at least one spout with an aperture formed therein and a plug which is sealingly engaged with the aperture. An intention in this respect is that the plug may be broken or it may become detached from the remainder of the body under the effect of a shockwave of a predetermined magnitude.

Breaking of the body can also be promoted by forming one or more lines of weakness in the material of the body. These lines of weakness may be adjacent protrusions which are subjected to substantial force by a shockwave. For example a protrusion on the container may be positioned so that it bears against a surface of a housing within which the container is positioned. If the container is subjected to a shockwave the container is forced against the surface. A restraining force is exerted on the protrusion, by an adjacent surface of the housing, which tends to push the protrusion in a direction towards an interior of the container. If the protrusion is adjacent one or more lines of weakness the resulting stress induced in the material of the container can cause these lines of weakness to break in a reliable and consistent manner. These protrusions may be regarded as pressure points.

The protrusions may be integral with the container but they may be formed separately from the container and attached thereto in any appropriate way.

The lines of weakness on the material of the body may be in the form of a plurality of corrugations over at least part of the body.

It is also possible to use the container in conjunction with one or more custom-designed penetrating devices. For example, a penetrating device with a sharp point may be positioned to face onto a surface of the container. The penetrating device may, in turn, be backed against a surface of a housing in which the container is installed. A shockwave impacting on the container can thereby cause the penetrating device to penetrate a wall of the container, a process which can be promoted by forming the wall of the container with one or more lines of weakness.

Use could also be made of an instantaneous electronic detonator, normally referred to as an IED, which is associated with the container in any appropriate way. The IED is typically of the type used, for example, to cause the expansion of an airbag in a vehicle. An IED is generally triggered by a suitable sensor which is capable of reacting rapidly to the effect of a shockwave. An IED may be positioned so that, upon initiation thereof, it directly causes the container to break. Alternatively the IED may be employed so that, upon initiation thereof, it starts a process whereby the container is broken, cracked or separated into two or more components by other means.

An IED may also be connected to one or more appropriate sensors which monitor the integrity of a wall or a roof of an enclosure, e.g. an ATM building, which houses a bank note dispenser. The sensors may be responsive to heat, vibration or the like and trigger the IED when a threshold level is crossed which is indicative of some form of attack or intrusion.

The container can also be used in conjunction with a signalling device e.g. a radio-frequency identification device (RFID) tag. The signalling device may detect any unauthorised activity such as tampering, explosive attack and physical attack e.g. by means of angle-grinder, a gas torch or the like and, when this is detected, a signal may be sent to a control location. The tag may itself trigger an IED, as described, or the tag may be used to send a signal which does not affect the container. Thus the container may, itself, still be used in the manner which has been described.

The invention extends, in the second instance, to a bank note dispenser which includes a holder for bank notes, a cover which is engageable with the holder and which then overlies the bank notes, and at least one protective device, of the aforementioned kind, engaged with the cover.

The cover and the container may have interengageable formations. Without being limiting the container may include one or more sockets, hollows or recesses and the cover may include one or more projections, such as spigots, which are of complementary shape to, and which are engageable with, the sockets, hollows or recesses.

The container may be secured, directly or indirectly, to the cover by using a suitable adhesive (such as double-sided adhesive tape), fasteners or the like. The invention is not limited in this respect.

The cover may include at least one longitudinally extending bank note guide rail, which ensures that bank notes are held in position within the holder, and at least one container of the aforementioned kind that is engaged with or is fastened to a supporting formation for the guide rail or to a formation on the cover such that the container is at least partly covered by the guide rail.

The container could be formed, at least partly, integrally with the guide rail, or with the cover. This allows for the easy inclusion of more than one container, an aspect which enhances security and increases the likelihood that at least one container will break with the force of a shockwave.

Each container may have a sealed aperture at opposed respective ends of the container. Preferably the container is made so that it has a symmetrical body so that it can be installed on one side of a cover or on an opposing side of a cover.

The guide rail may be weakened in any suitable way e.g. by including one or more small openings or lines of weakness over a surface of the rail, in order to promote breaking of at least the container which is situated adjacent the guide rail. The openings allow the passage of pressure-wave effects to impact directly on exposed regions of the container.

The guide rail may be formed from any suitable material. Preferably the guide rail is formed from styrene. It has been found through experimentation that as the guide rail overlies the container it acts in some way to strengthen the container and, if the guide rail is not appropriately formed, the degree of protection can be such that the container does not break under the effect of a shockwave. For this reason the guide rail, as noted, may have a number of openings or formations which help to promote breakage of the container when there is a shockwave event. The guide rail, itself, preferably breaks.

In one preferred form of the invention the cover for the bank note dispenser includes a first container of the aforementioned kind on one side of the cover, a second container of the aforementioned kind on an opposed side of the cover, and each container is covered at least partly by a respective guide rail. It is possible to secure a third container to the cover between the guide rails.

Alternatively, or additionally, a container is engaged with the cover, such that it is located between two of the guide rails. The container may be fastened to the cover through adhesive means or it may be engaged with formations on the cover.

Each container may be, at least partly, integral with the inner surface of the cover or with the respective guide rail or may be fastened to the cover or the guide rail.

BRIEF DESCRIPTION OF THE DRAWINGS

The invention is further described by way of example with reference to the accompanying drawings in which.

DESCRIPTION OF PREFERRED EMBODIMENT

Figure 1:
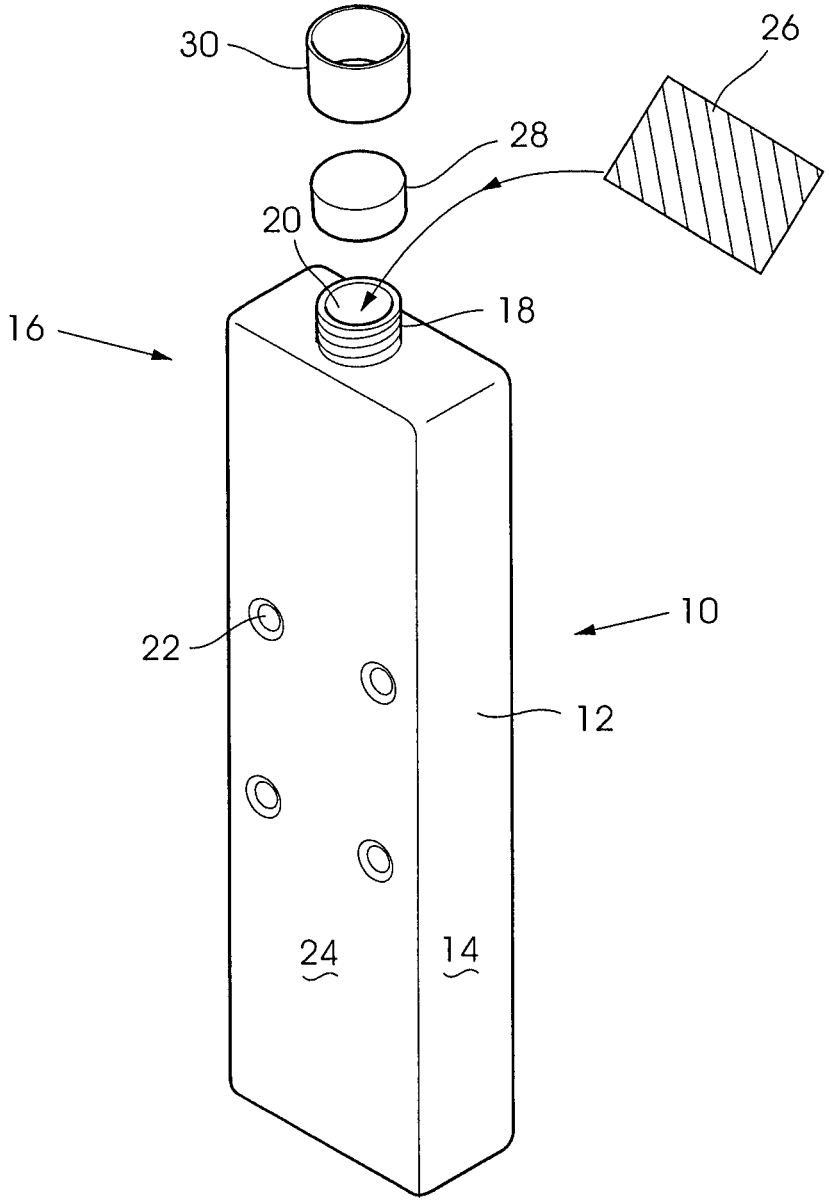
FIG. 1 illustrates a protective device according to one form of the invention.

FIG. 1 of the accompanying drawings illustrates a protective device 10 according to the invention which includes an elongate container 12 with a body 14.

The body is made from a material which breaks or bursts under the effect of a shockwave in excess of a predetermined magnitude. Additionally, the material is such that it can contain a dye, adhesive, a solvent, acid, chemical composition, or another chosen bank note traceability substance for an indefinite period in a secure and leak-proof manner. A suitable material which has been established through extensive experimentation is high density polyethylene (HDPE).

The body 14 is rectangular in outline and, at one end 16, includes a filling spout 18 with an aperture 20. The body has a number of zones or lines of weakness 22 which are shown in FIG. 1 as sockets. These are positioned at strategic locations on a large flat face 24 of the body. A similar structure is adopted on the reverse side of the body (not shown in FIG. 1). The lines, or zones, of weakness may be formed in any appropriate pattern and the sockets shown in FIG. 1 are exemplary only.

The thickness of the wall of the body and the material used in its manufacture (in this example HDPE), are determined taking into account a number of factors. Thus the container should have an extended lifetime which does not degrade under the effect of its contents. Additionally the container should be robust so that it can withstand the effects of normal wear and tear. On the other hand the container should break if it is subjected to an explosive shock wave which generates a compressive force on the container in excess of a force which would be exerted on the container in normal usage. It has been determined through thorough testing that the body, when made from a high density polyethylene, should have a wall thickness of about 1.5 mm.

The container is filled with a substance 26 and then sealed. The substance inside the container is one which gives rise to a bank note traceability factor. In one embodiment the substance is a dye which is similar to an ink which is used for the printing of bank notes. This dye has a long life and, for practical purposes, can be regarded as being of a permanent nature when applied to a bank note. In another embodiment the substance is a fluid adhesive that stays fluent while in the container but which hardens after exposure to air. In this event it adheres strongly to each bank note with which it comes into contact. Use may be made of a proprietary epoxy glue. In a further embodiment the substance is a noxious gas such that, upon breaking of the container, the gas impregnates the bank notes with a distinct odour. Each substance may be used on its own or in conjunction with at least one of the other substances e.g. a combination of a dye and a fluid adhesive, or of a noxious gas and a coloured adhesive.

Generally the container will be closed by means of a mechanism such as a plug or screw cap 28 which is engaged with the spout 18. If the spout is formed from a plastics material, the spout can be severed and heat sealed in a leak-proof manner. After the spout has been sealed, a small sleeve 30 of a heat-shrinkable material is placed over the spout (or cap if used), and exposed to heat so that it shrinks and crimps tightly to an outer surface of the spout. This enhances the closure and the seal, and helps to prevent tampering with the container.

Figure 2:
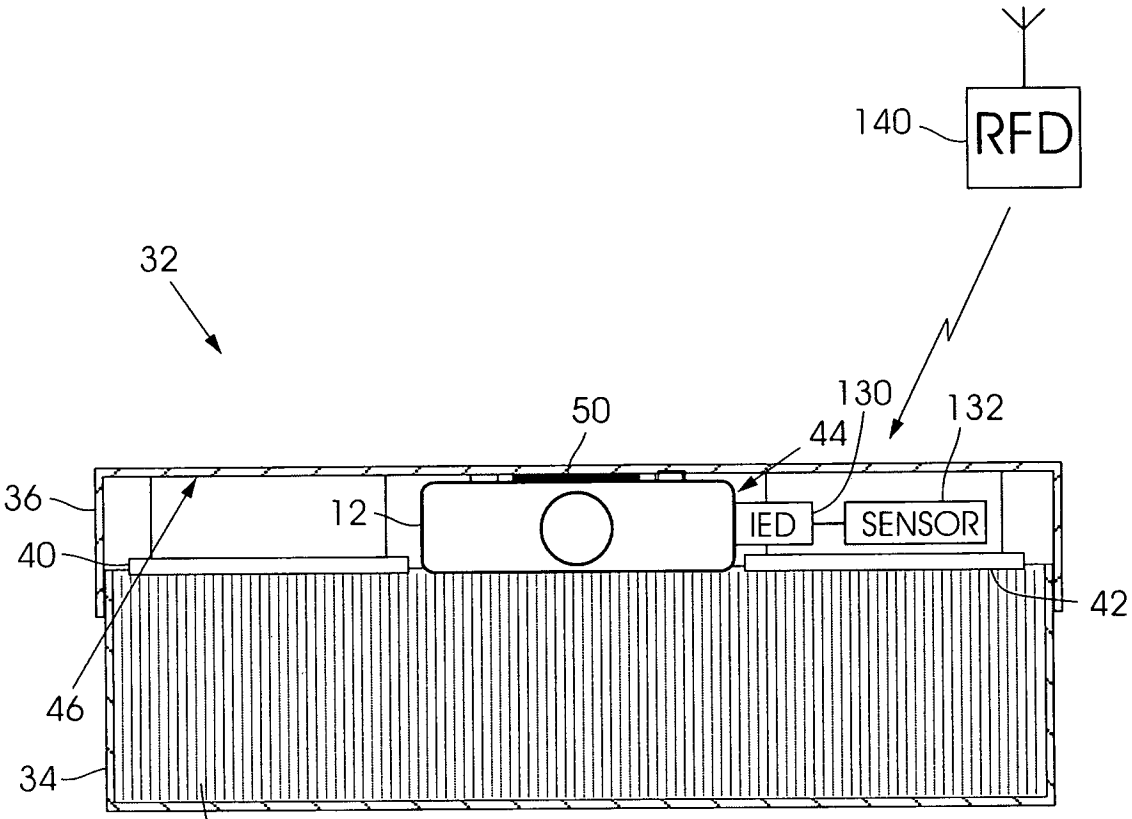
FIG. 2 illustrates in cross-section a bank note dispenser which includes the device of FIG. 1.

FIG. 2 illustrates, in cross-section, a bank note dispenser 32 which includes a holder 34 and a cover 36. The holder 34 is sized to take a large number of bank notes 38, stacked one against the other, which are positioned edge-on inside the holder. The cover 36 is custom-designed to fit onto the holder and includes locating and pressure formations 40 and 42 respectively which are positioned to bear lightly on upper ends of the bank notes 38. The container 12 is designed and shaped to fit into a recess 44 formed between the formations 40 and 42.

The container is engaged with an inner surface 46 of the cover using any appropriate technique. For example, double-sided adhesive tape 50 may be used to fix the container to the surface 46. It is also possible to use interengageable formations, not shown, on the cover 36 and the container.

If the bank note dispenser, located say, inside an ATM (not shown), is subjected to a shock wave produced, for example, by gas or chemical explosion then the effect of the shock-wave on the container is such that the body of the container is fractured or broken. The substance 26 is violently dispersed throughout the container and the bank notes 38 are marked or otherwise affected by the substance, depending on the nature of the substance.

The socket formations 22 constitute zones of weakness which help to promote breakage of the container body. However these zones of weakness do not interfere with the way in which the container can be used under normal situations. The zones of weakness can be formed in different ways and the invention is not confined to the use of sockets. As is explained hereinafter the zones of weakness can be corrugations, ribs and channels or the like. In general terms any weakened region of the body at a region at which increased stress can be induced, can function to promote breakage of the body.

Figure 2A:
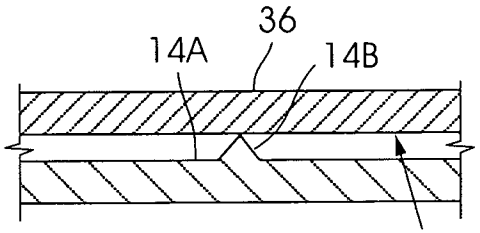

FIG. 2A for example illustrates, in cross-section, a wall 14A of a container body which is formed with a number of outwardly extending projections 14B (only one is shown in the drawing). Each projection faces onto an inner surface 46 of a cover 36 with which the container is associated. When a shockwave occurs the formation 14B is pressed against the surface 46 and this induces stress in the wall 14A which helps to promote breakage of the container wall.

Figure 3:
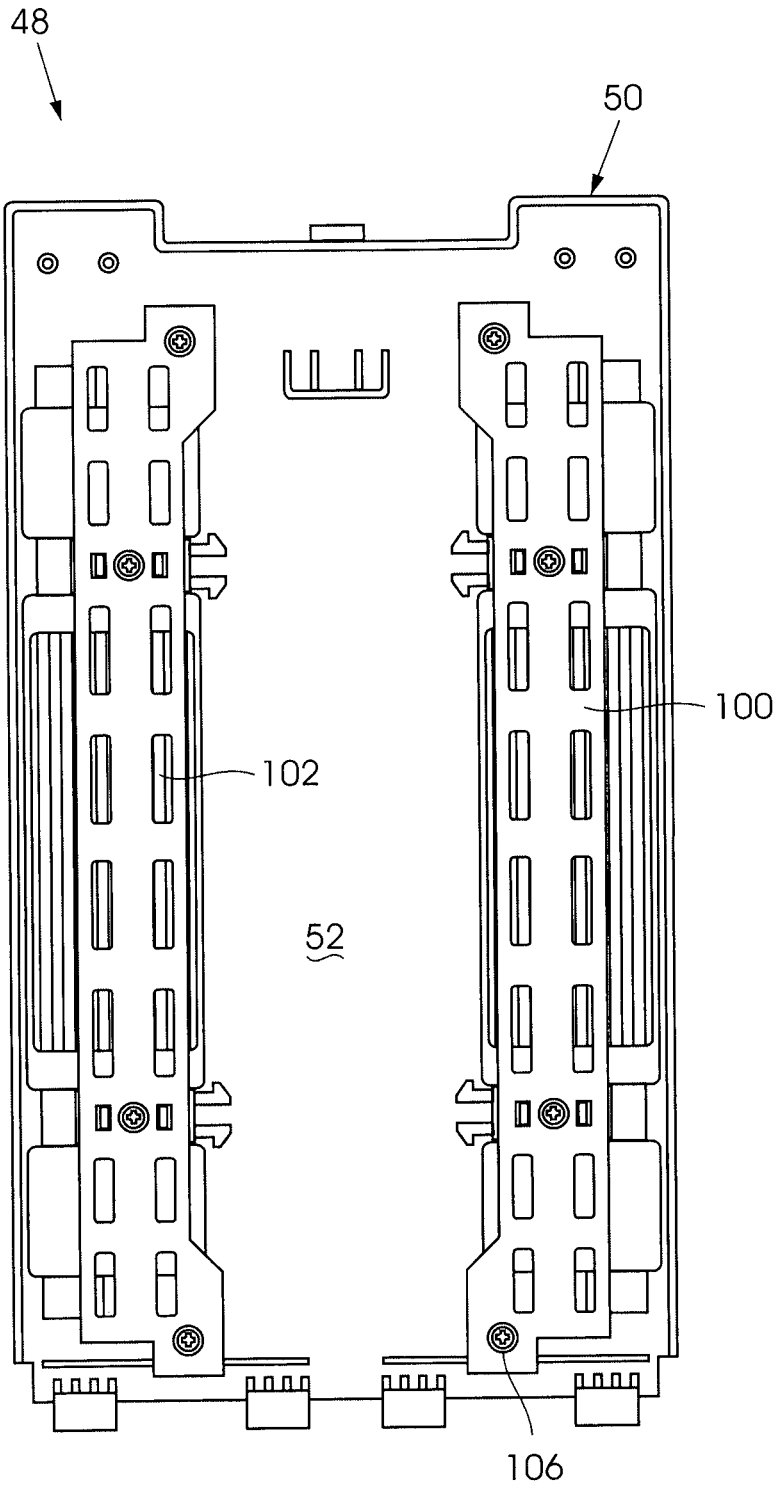
FIG. 3 is an underplan view of a cover arrangement which includes two protective devices, according to another form of the invention.
Figure 4:
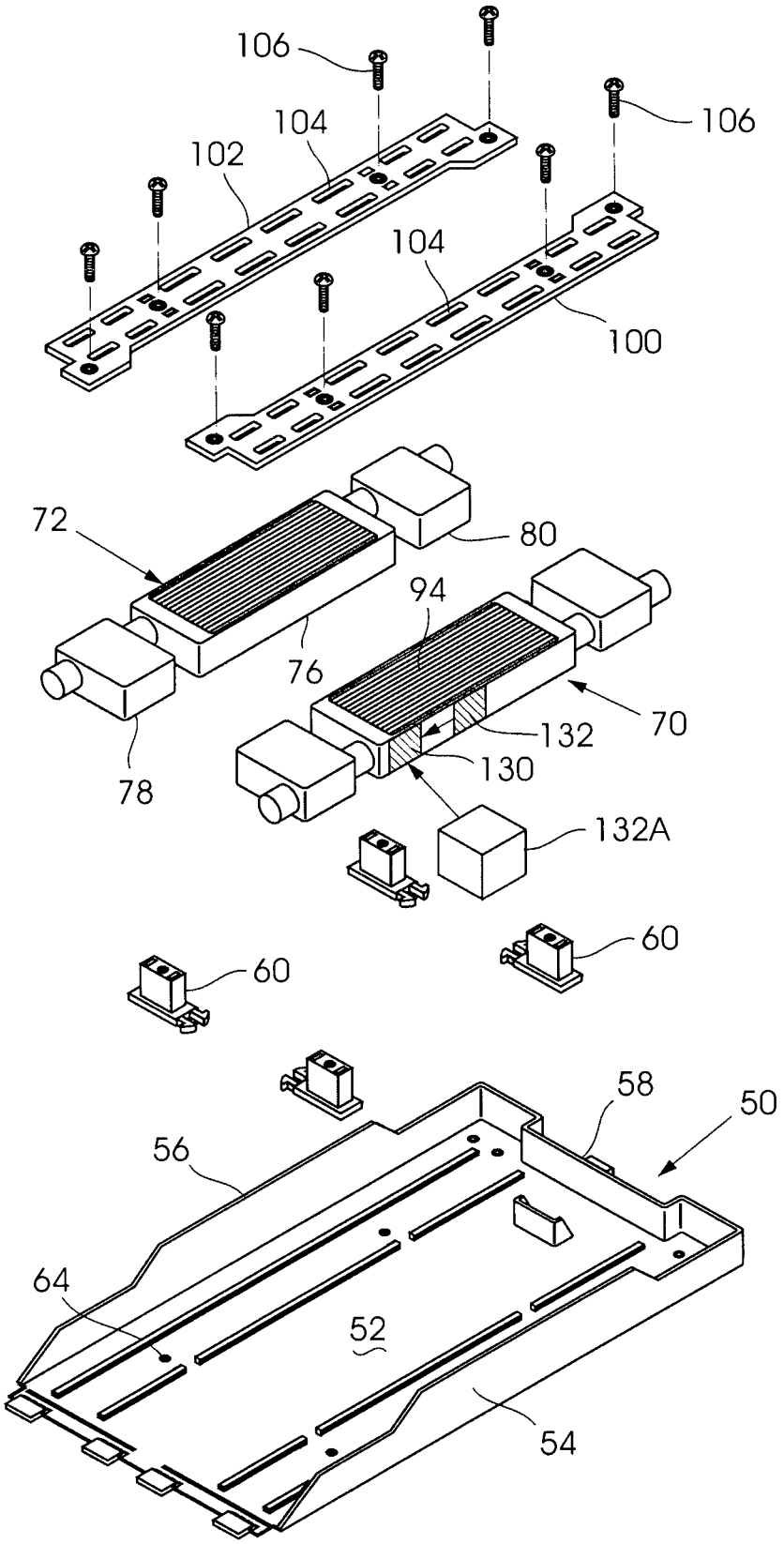
FIG. 4 shows the cover arrangement of FIG. 3, in an exploded configuration.
Figure 5:
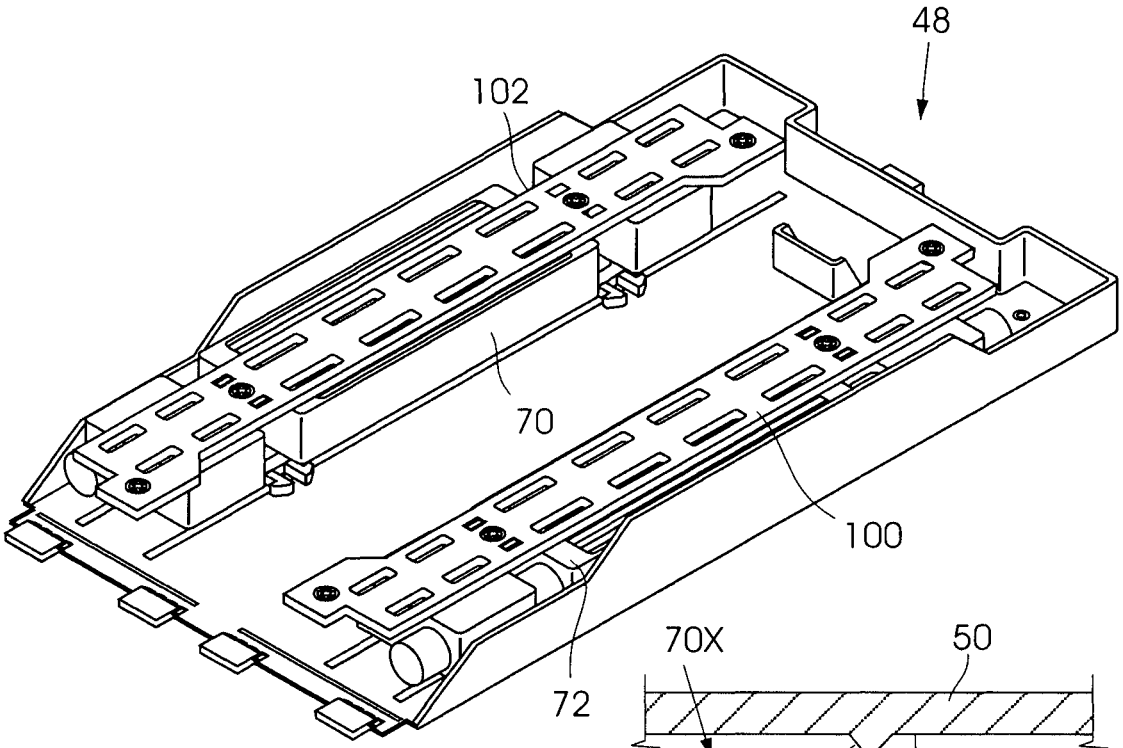
FIG. 5 is a perspective view of the cover arrangement shown in FIG. 3.
Figure 6:
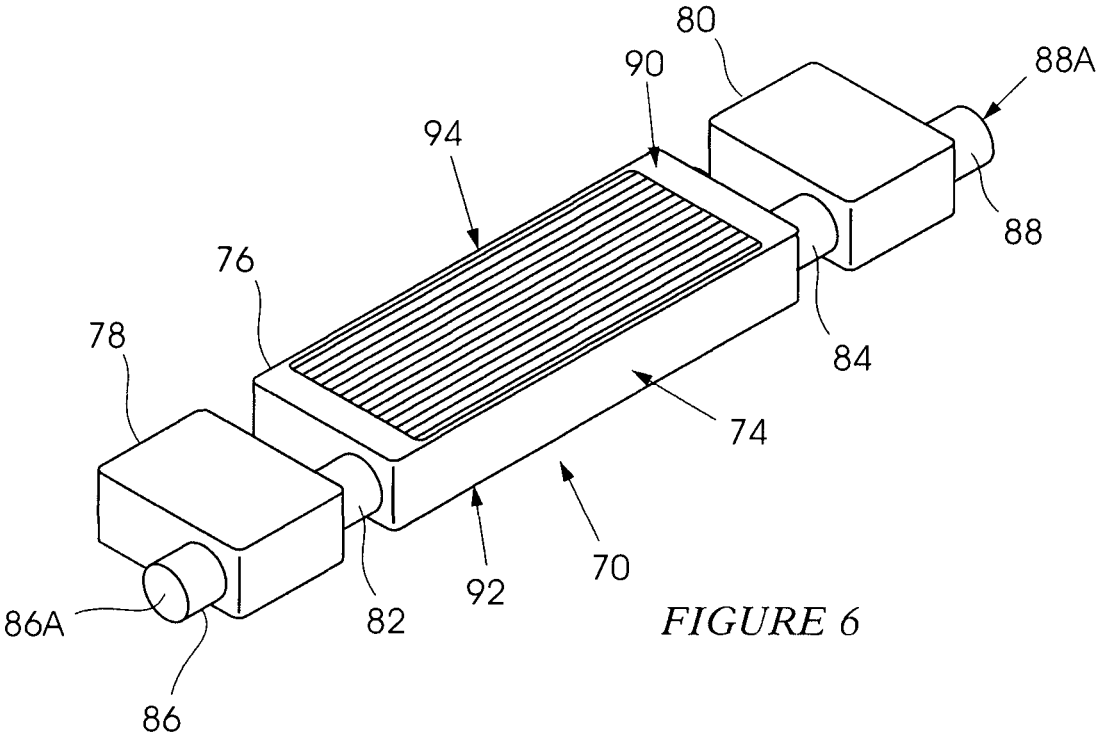
FIG. 6 is an enlarged view of a container used in the cover arrangement.

FIG. 3 is an underplan view of a cover arrangement 48 which, in use, is engaged with a bank note dispenser, not shown, according to a preferred form of the invention. FIG. 4 shows the arrangement of FIG. 3 in an exploded form while FIG. 5 is a perspective view of the arrangement of FIG. 3. FIG. 6 is an enlarged view of a container used in the cover arrangement.

The cover arrangement includes a cover 50 which has an inner surface 52 with opposed side walls 54 and 56 respectively and an end wall 58. Custom-designed spacers 60 are clipped to formations on the inner surface.

The cover is standard and, to take account of its shape and size, a container 70, according to the invention, is made so that it can be used effectively with the cover. The nature of the container is such that the two identical containers, designated 70 and 72 respectively, can be used with the cover.

The container 70 has a body 74 (see FIG. 6) which is blow-moulded from high density polyethylene. The wall thickness of the body is carefully controlled so that it has a substantial degree of strength and can withstand normal wear and tear, and shock effects which are not particularly high. The body has a central region 76, two wings 78 and 80 respectively which are joined to the central region by means of respective short cylinders 82 and 84, and two protruding cylindrical spouts 86 and 88 at respective opposed ends of the body. The central region 76 on an upper surface 90 and on an opposed lower surface 92 (not visible) is formed with a plurality of corrugations 94, in the form of ridges and grooves, which define a multitude of lines of weakness.

Each container is filled under factory conditions with a bank traceability substance of the kind referred to herein-before. Each cylindrical spout 86, 88 has a respective aperture 86A, 88A. One aperture is used for placing the substance into the container while the other aperture allows air to escape from the container, during filling. Once the container has been filled the spouts are sealed in any appropriate way but, preferably, in a manner similar to that described in connection with FIG. 1.

The cover arrangement includes two identical guide rails 100 and 102. Each guide rail is made from a tough material such as styrene and includes a number of apertures 104 which are at strategic positions.

When the components shown in FIG. 4 are assembled the spacers are first positioned on and clipped to the inner surface 52. Thereafter the containers 70, 72 are placed firmly against the surface 52 and are aligned with the spacers. The guide rails 100 and 102 are then placed over the containers and are fixed to the spacers 60 using the fasteners 106. Additional spacers (not shown) are used, as required, to support each container.

The construction shown in FIGS. 3, 4 and 5 is symmetrical in that either container could be used on either side of the cover. Also, the guide rails can be interchanged, if necessary. The fasteners 106 are one-way fasteners i.e. they can be screwed into position using a star (Phillips) screwdriver but when an attempt is made to remove a fastener the screw-driver does not grip slots in a head of the fastener—these slots are shaped in a known manner to prevent unfastening.

The wings 78 and 80 are spaced from the region 76 by the cylinders 82 and 84 so that the container closely flanks the spacers to which the guide rails are attached. The guide rails overlie the containers to a substantial extent.

In use the cover is placed on a holder which is filled with bank notes, much in the manner shown in FIG. 2. Lower surfaces of the guide rails bear against the bank notes and help to keep the notes in position for dispensing purposes—an aspect which is not important to an understanding of the invention. If an attack takes place on an ATM in which the bank note dispenser is held, then a shockwave is established which fractures the containers. The lines of weakness formed by the corrugations are important for these promote breakage of the containers.

Through experimentation it has been observed that if the guide rails are too strong they can protect the containers and in this way breakage of the containers might not occur. At least for this reason the guide rails are formed with the apertures 104. There are sufficient apertures to allow shock-wave effects to be transmitted to the container surface but, on the other hand, the apertures are not so numerous that the guide rail is weakened and cannot fulfil its normal function of interacting with the bank notes. Another factor is that the material used for the guide rails should not be too strong for, ideally, the guide rails should, themselves, also fracture under the effect of a shockwave. For this reason the guide rails are made from styrene—a material which has been shown through experimentation to be effective.

If a container fractures or breaks then the substance held in it is automatically released. Shockwave and gravity action ensure that the substance is dispersed randomly and violently, but in all directions. The substance impacts the bank notes which are abutting against the guide rails and marks or interacts with substantially all of the bank notes in such a way that they are distinguished from non-marked or standard bank notes. Coverage is not confined to the bank notes in a relatively small area.

There is limited space available in the cover and careful design of the container is necessary to ensure that the container has a maximum volume. This allows each container to hold a maximum volume of the bank note traceability substance.

Another benefit of the construction shown is that unless a respective guide rail is removed it is not possible, without breaking a container, to remove a container from its installed position.

The design of the container 70 ensures that the same container can be installed on the left or right-side of the cover. The installations of the containers beneath the left and right-side guide rails are therefore symmetrical.

Figure 7:
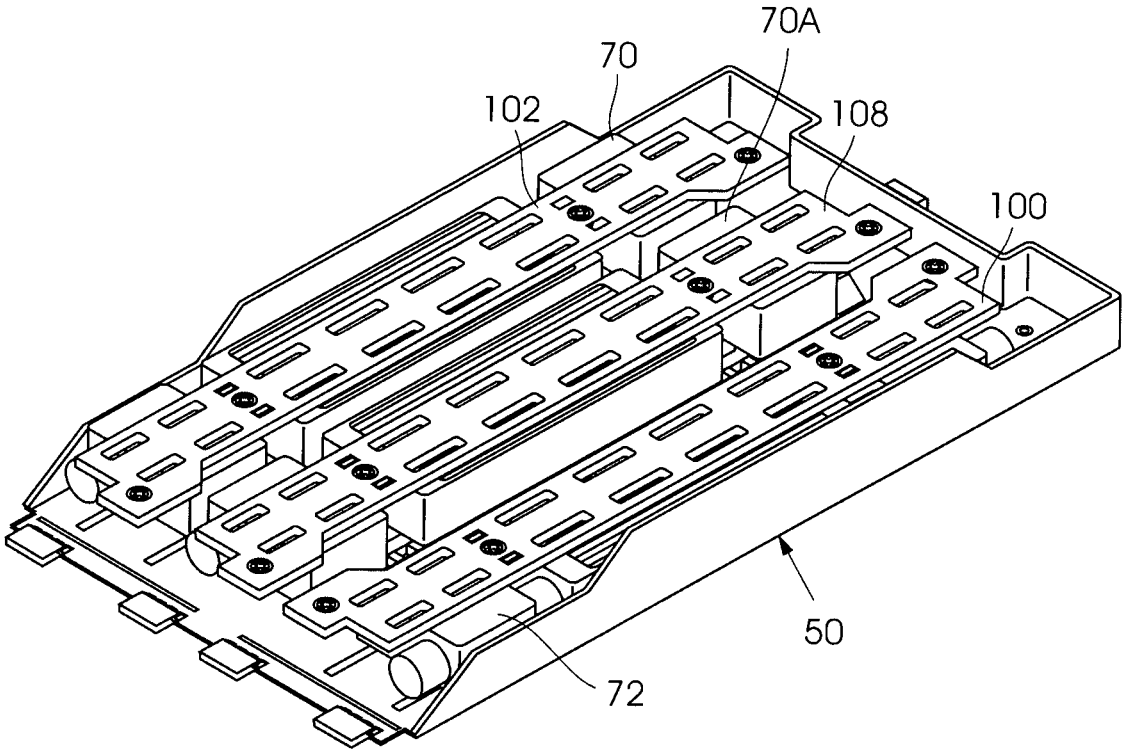
FIG. 7 shows a variation of the cover arrangement in FIG. 5.

FIG. 7 illustrates a variation of the form of the invention shown in FIG. 3. Like reference numerals are used to designate like components. The structure shown in FIG. 5 is employed but, additionally, a third container 70A used, positioned between the containers 70 and 72. Also a third guide rail 108 is used to cover the container 70A. The third container 70A will normally be reduced in size so that it does not interfere with the working of components (not shown) which are included in the bank note dispenser.

In one form of the invention each container is formed integrally with the cover 36 or 50 as the case may be.

In another possible configuration the container 70 is formed with an aperture (86A) which is sealed by means of a plug. The plug is weaker than a wall surrounding the aperture. It may for example be made from a thinner material or from a different material than the body of the container. Under the effect of a shockwave the plug breaks or becomes detached from the container body and when this occurs the substance inside the container is dispersed, generally violently, and interacts with bank notes adjacent the container.

Figure 5A:
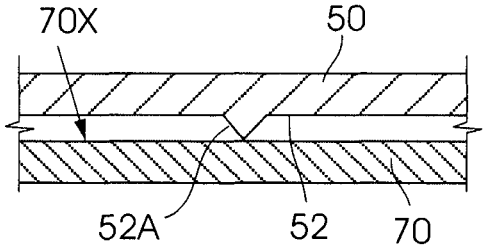

In an alternative embodiment—see FIG. 5A, positioned on the inner surface 52 is at least one penetrating device 52A which includes a base which is adhered to or which is integral with, the surface 52 and a pointed end that faces a wall 70X of the body of the container 70. Under normal conditions the projection is not capable of piercing the wall. However if a shockwave is generated, the container body is urged towards the surface 52 and a localised region of high pressure is formed in the body as the projection bears against the wall. This high pressure produces a force which is sufficient to penetrate or break the wall.

In a further embodiment, see FIG. 4, an IED (instantaneous electronic detonator) 130 is securely attached to a surface of the container 70 or is located in a hollow formed in the container. The IED opposes, for example, the inner surface 52 and the side wall 54 of the cover 50. The IED may be similar to a device used for causing inflation of an airbag in a motor vehicle. This type of device is, triggered by a sensor 132 which acts in response to a shockwave and explodes rapidly. The resulting force, generated by the explosion, is capable of breaking the container 70.

Although, currently, most cash depositories such as ATM's are targeted by explosive mechanisms, in order to obtain access to the cash contents thereof, there are occasions when use is made of other mechanisms to penetrate an enclosure. For example an oxy-acetylene torch, an angle grinder, or a similar cutting apparatus can be used to gain access to the contents of an ATM or an equivalent cash enclosure. To address this type of attack the IED 130, which may be one of a number of similar IED's, is responsive to a sensor 132A, similar to the sensor 132, which monitors the integrity of a wall or roof of an enclosure, e.g. an ATM building, which houses a bank note dispenser. Each sensor may be responsive to heat, vibration or the like. In one form of the invention each wall or wall surface which could be targeted by an intruder is traversed by a number of wires (not shown). Breakage of any one of the wires is detected by a respective sensor 132A which immediately causes initiation of at least one IED 130. That, in turn, breaks the container 70 and the bank note dye (or other substance) is dispersed onto the bank notes.

FIG. 2 illustrates that the protective device of the invention can be used in conjunction with a signalling device such as a radio-frequency identification device (RFID) tag 140. The signalling device detects direct or indirect interference with the container (an unauthorised event) for example if an attempt is made to remove the container from a dispenser. In this event a signal is transmitted by the RFID tag to a control location so that personnel there are alerted to the event. Additionally, when the RFID is actuated a signal may be sent to a sensor 132 and upon receipt of this signal the sensor causes the IED 130 to be detonated.

The invention claimed is:

1. A bank note dispenser positionable inside an automated teller machine (ATM), comprising:

a holder for bank notes;

a cover which is engageable with the holder and which overlies the bank notes;

a sealed container which is engaged with an inner surface of the cover, the container comprising a body made from a material, selected from either of a glass or plastics material, which breaks under the effect of a shock wave outside of the container, said shock wave established by an attack on the ATM and which is in excess of a predetermined magnitude;

at least one bank note guide rail, fixed to the cover and spaced from the inner surface, which at least partly covers the container and which bears against the bank notes to ensure that the bank notes are held in position within the holder; and a liquid dye inside the container which, upon breakage of the body, is automatically released and dispersed randomly, due to action of the shockwave and gravity action, onto the bank notes thereby to mark substantially all of the bank notes in such a way that the marked banknotes are distinguished from non-marked banknotes, thereby to give rise to a bank note traceability factor.

2. The bank note dispenser according to claim 1 wherein the container is made from high density polyethylene and has a body with a wall thickness of about 1.5 mm.

3. The bank note dispenser according to claim 1 wherein the container is formed with one or more zones of weakness.

4. The bank note dispenser according to claim 3 wherein the zones of weakness comprise corrugations over at least part of the material of the body.

5. The bank note dispenser according to claim 1 wherein the cover and the container have interengageable formations.

6. The bank note dispenser according to claim 1 wherein the guide rail has one or more openings which overlie part of the container.

7. The bank note dispenser according to claim 1 wherein the container is at least partly integral with the cover.

8. The bank note dispenser according to claim 1 wherein the container is at least partly integral with the guide rail.

9. The bank note dispenser according to claim 1 wherein the container, once engaged with the cover and exposed to the bank notes is not removable, without breaking the container, unless the respective at least one guide rail is removed.

10. The bank note dispenser according to claim 1 wherein the cover has a left side and a right side and the bank note dispenser has a left side guide rail and a right side guide rail and the design of the container allows the container to be installed on the left side or on the right side of the cover.

11. The bank note dispenser according to claim 9 wherein the cover has a left side and a right side and the bank note dispenser has a left side guide rail and a right side guide rail and the design of the container allows the container to be installed on the left side or on the right side of the cover.

12. The bank note dispenser according to claim 1, wherein the container includes a plurality of lines of weakness.

13. The bank note dispenser according to claim 12, wherein the plurality of lines of weakness are grooves along which a thickness of the material of the container is reduced.

14. The bank note dispenser according to claim 1, wherein the container includes a plurality of lines of weakness, with at least one line of weakness adjacent a protrusion of the container.

15. The bank note dispenser according to claim 12, wherein the plurality of lines of weakness are grooves along which a thickness of the material of the container is reduced, and wherein at least one line of weakness is adjacent a protrusion of the container.

16. The bank note dispenser according to claim 1, wherein the container includes a plurality of lines of weakness, and a penetrating device with a sharp point that points towards the container and is backed against a surface of the holder or cover.

17. A bank note dispenser positionable inside an automated teller machine (ATM), comprising:

a holder for bank notes;

a cover which is engageable with the holder and which overlies the bank notes;

a sealed container formed with one or more zone of weakness and which is engaged with an inner surface of the cover, the container comprising a body made from a material, selected from either of a glass or plastics material, which breaks under the effect of a shock wave outside of the container, said shock wave established by an attack on the ATM and which is in excess of a predetermined magnitude;

at least one bank note guide rail, fixed to the cover and spaced from the inner surface, which at least partly covers the container and which bears against the bank notes to ensure that the bank notes are held in position within the holder; and a liquid dye inside the container which, upon breakage of the body, is automatically released and dispersed randomly, due to action of the shockwave and gravity action, onto the bank notes thereby to mark substantially all of the bank notes in such a way that the marked banknotes are distinguished from non-marked banknotes, thereby to give rise to a bank note traceability factor.

* * * * *